US006464800B1

(12) United States Patent
Carlson et al.

(10) Patent No.: US 6,464,800 B1
(45) Date of Patent: Oct. 15, 2002

(54) VISIBLE CHROMIUM- AND PHOSPHORUS-FREE CONVERSION COATING FOR ALUMINUM AND ITS ALLOYS

(75) Inventors: Lawrence R. Carlson, Oxford; Patrick A. Scalera, Canton; Therese E. Niemi, Ypsilanti; Shawn E. Dolan, Sterling Heights, all of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/830,729

(22) PCT Filed: Oct. 29, 1999

(86) PCT No.: PCT/US99/23989

§ 371 (c)(1),
(2), (4) Date: Apr. 30, 2001

(87) PCT Pub. No.: WO00/26437

PCT Pub. Date: May 11, 2000

Related U.S. Application Data

(60) Provisional application No. 60/106,353, filed on Oct. 30, 1998.

(51) Int. Cl.[7] ..... C23C 22/84

(52) U.S. Cl. ..... 148/244; 148/247; 148/274; 148/276; 148/251; 252/393

(58) Field of Search ..... 148/244, 247, 148/274, 276, 251; 428/472, 472.1; 252/393

(56) References Cited

U.S. PATENT DOCUMENTS

| | | | | |
|---|---|---|---|---|
| 2,927,872 A | | 3/1960 | Cohn | 148/6.1 |
| 3,592,747 A | * | 7/1971 | Cohn | 148/279 |
| 3,765,952 A | | 10/1973 | Tuttle et al. | 148/6.1 |
| 4,963,596 A | | 10/1990 | Lindert et al. | 526/313 |
| 5,068,299 A | | 11/1991 | Lindert et al. | 526/313 |
| 5,281,282 A | | 1/1994 | Dolan et al. | 148/247 |
| 5,342,456 A | | 8/1994 | Dolan | 148/247 |
| 5,356,490 A | | 10/1994 | Dolan et al. | 148/247 |
| 5,505,792 A | | 4/1996 | Ouyang et al. | 148/241 |
| 5,534,082 A | | 7/1996 | Dollman et al. | 148/247 |

OTHER PUBLICATIONS

*Kirk–Othmer Encyclopedia of Chemical Technology*, 3rd Edition, vol. 8, pp. 270–274 (1979) (no month data).

* cited by examiner

*Primary Examiner*—John Sheehan
*Assistant Examiner*—Andrew L. Oltmans
(74) *Attorney, Agent, or Firm*—Stephen D. Harper

(57) ABSTRACT

A visible colored chromium- and phosphorus-free conversion coating can be formed on a metal surface by contacting it with an aqueous liquid composition that comprises an alizarine dye and a product of chemical interaction between a first initial reagent component selected from the group consisting of fluoroacids of the elements titanium, zirconium, hafnium, boron, aluminum, silicon, germanium, and tin; and a second initial reagent component selected from the group consisting of titanium, zirconium, hafnium, boron, aluminum, silicon, germanium, and tin and all of oxides, hydroxides, and carbonates of all of titanium, zirconium, hafnium, boron, aluminum, silicon, germanium, and tin.

27 Claims, No Drawings

VISIBLE CHROMIUM- AND PHOSPHORUS-FREE CONVERSION COATING FOR ALUMINUM AND ITS ALLOYS

This application claims priority from U.S. Provisional application No. 60/106,353, filed Oct. 30, 1998 and International application PCT/US99/23989, filed Oct. 29, 1999, and published under PCT Article 21(2) in English.

BACKGROUND OF THE INVENTION

Conversion coating in general is a well known method of providing aluminum and its alloys (along with many other metals) with a corrosion resistant coating layer. The most effective method of controlling the thickness of the conversion is by measurement of its mass per unit area coated, a characteristic that is usually called "coating weight", but some users who do not require the most careful control of this property prefer a visual indication of the thickness of the coating, because it is sufficiently accurate for their purposes and is faster and cheaper than measurements of coating weight. Both traditional types of conversion coatings for aluminum, the chromate and phosphate types, are capable of providing a visual indication of thickness. However, both chromium and phosphorus are often environmentally objectionable, so that their use should be minimized for that reason. Conversion coating compositions and methods that do not need the use of chromium or phosphorus are taught in U. S. Pat. Nos. 5,356,490 and 5,281,282, both of which are assigned to the same assignee as this application. These compositions and processes have been successful when the coating weight produced by using them is controlled, but these compositions form substantially colorless and transparent conversion coatings that do not provide any adequate visual indication of coating thickness.

Accordingly, a major object of this invention is to provide a conversion coating and composition and process therefor that gives a visual indication of coating weight that is at least as reliable as that from conventional chromate conversion coating but minimizes, or most preferably entirely avoids, the use of chromium and phosphorus. Still other concurrent and/or alternative objects will be apparent from the description below.

Except in the claims and the operating examples, or where otherwise expressly indicated, all numerical quantities used in the description of the invention to indicate amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of materials in ionic form implies the presence of sufficient counterions to produce electrical neutrality for the composition as a whole; any counterions thus implicitly specified preferably are selected from among other constituents explicitly specified in ionic form, to the extent possible; otherwise such counterons may be freely selected, except for avoiding counterions that act adversely to the objects of the invention; the word "mole" means "gram mole" and the word itself and all of its grammatical variations may by used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous phase", and the like are to be understood as including not only true equilibrium solutions or homogeneity but also dispersions that show no visually detectable tendency toward phase separation over a period of observation of at least 100, or preferably at least 1000, hours during which the material is mechanically undisturbed; and, unless otherwise explicitly stated or necessarily implied by the context, the simple term "aluminum" includes pure aluminum and those of its alloys that contain at least, with increasing preference in the order given, 55, 65, 75, 85, or 95 atomic percent of aluminum atoms.

BRIEF SUMMARY OF THE INVENTION

It has been discovered that alizarine dyes can be added to treatment compositions as otherwise taught by U. S. Pat. Nos. 5,356,490 and 5,281,282 to generate treatment compositions that maintain most of the other properties of these previously known compositions but produce a strongly colored conversion coating instead of a substantially colorless one. These colored conversion coatings have the beneficial corrosion protective properties of those produced according to the teachings of these U. S. Pat. Nos. 5,356,490 and 5,281,282 and have the additional benefit of a readily visible indication of their presence and at least their approximate thickness.

DETAILED DESCRIPTION OF THE INVENTION

A composition according to this invention begins with a precursor composition that comprises, preferably consists essentially of, or more preferably consists of, water and:

(A.1) a first initial reagent component of at least one dissolved fluoroacid of an element selected from the group consisting of titanium, zirconium, hafnium, boron, aluminum, silicon, germanium, and tin; and (A.2) a second initial reagent component of one or more of dissolved, dispersed, or both dissolved and dispersed finely divided forms of (i) elements selected from the group consisting of titanium, zirconium, hafnium, boron, aluminum, silicon, germanium, and tin and (ii) all of oxides, hydroxides, and carbonates of all of titanium, zirconium, hafnium, boron, aluminum, silicon, germanium, and tin.

These necessary initial reagent components are caused to chemically interact in such a manner as to produce a homogeneous composition that is itself useful for metal treatment but is not normally a composition according to this invention because it does not yet contain dye. If initial reagent component (A.2) is present in dispersion rather than solution, as is generally preferred, the precursor composition normally will not be optically transparent, because of the scattering of visible light, in a thickness of 1 centimeter (hereinafter usually abbreviated as "cm"), and completion of the desired chemical interaction is indicated by the clarification of the composition. If reagent components (A.1) and (A.2) as defined above are both present in the precursor aqueous composition in sufficiently high concentrations, adequate chemical interaction between them may occur at normal ambient temperatures (i.e., 20–25° C.) within a practical reaction time of 24 hours or less, particularly if component (A.2) is dissolved or is dispersed in very finely divided form. Mechanical agitation may be useful in speeding the desired chemical interaction and if so is preferably used. Heating, even to relatively low temperatures such as 30° C., is often useful in speeding the desired chemical interaction, and if so is also preferred. (The chemical interaction needed is believed most probably to produce oxyfluro complexes of the elements or their compounds of necessary initial reagent component (A.2), but the invention is not limited by any such theory.) The desired chemical interaction between components (A.1) and (A.2) of the mixed composition eliminates or at least markedly reduces any tendency toward settling of a dispersed phase that might otherwise occur upon long term storage of the initial mixture of water and components (A.1) and (A.2) as defined above.

In addition to a product of reaction between initial reagent components (A.1) and (A.2) as described above, another necessary component of a composition according to this invention is an alizarine dye. Alizarine itself is 1,2-dihydroxyanthraquinone, and an alizarine dye molecule includes the anthraquinone nucleus with some substituent in each of at least the 1 and 2 positions of anthraquinone. Any one or more of the other individual hydrogen atoms in anthraquinone may also be replaced by hydroxyl, amino, nitro, or sulfonyl moieties, and one or more hydrogen atoms of any such hydroxyl or amino moieties may themselves be substituted by another organic moiety, preferably an aryl moiety, by an ester/amide bond to an organic or inorganic acid, or by an ether oxygen or amino nitrogen bond to another organic moiety, while the hydrogen atom/cation of a substituted sulfonyl group may be replaced by a metal atom/cation. Additionally, any two of the other individual hydrogen atoms that occupy suitably adjacent positions can be substituted by carbon-carbon bonds that are part of an additional aromatic ring fused onto the anthraquinone nucleus. Numerous molecular formulas of practically used alizarine dyes are given in *Kirk-Othmer Encyclopedia of Chemical Technology,* 3rd Edition, Vol. 8, pp 270–274 (1979), and any of these are suitable for use according to this invention. A preferred group of dyes includes: Xanthylium, 9-(2-carboxyphenyl)-3,6-bis(diethylamino)-, chloride (CAS Registry Number 81-88-9); Benzenemethanaminium, N-ethyl-N-[4-[[4-[ethyl[(3-sulfophenyl)methyl]amino]phenyl](2-sulfophenyl)methylene]-2,5-cyclohexadien-1-ylidene]-3-sulfo-, inner salt, diammonium salt (CAS Registry Number 2650-18-2); Xanthylium, 3,6-bis(diethylamino)-9-(2,4-disulfophenyl)-, inner salt, sodium salt (CAS Registry Number 3520-42-1); Spiro[isobenzofuran-1(3H),9'-[9H]xanthen]-3-one; 3',6'-bis(diethylamino)- (CAS Registry Number 509-34-2); Xanthylium, 9-(2-carboxyphenyl)-3,6-bis(diethylamino)-; and Xanthylium, 9-[4-(chlorosulfonyl)-2-sulfophenyl]-3,6-bis(diethylamino)-, inner salt. Among these, the first two are more preferred and the first most preferred.

The compositions resulting from chemical interaction as described above and also containing alizarine dye may and often preferably do contain other optional components. Most often preferred among these optional components are water-soluble or -dispersible polymers, which preferably are selected from the group consisting of: (1) polymers of one or more x-(N-$R^1$-N-$R^2$-aminomethyl)-4-hydroxy-styrenes, where x (the substitution position number)=2, 3, 5, or 6, $R^1$ represents an alkyl group containing from 1 to 4 carbon atoms, preferably a methyl group, and $R^2$ represents a substituent group conforming to the general formula $H(CHOH)_nCH_2$—, where n is an integer from 1 to 7, preferably from 3 to 5 (these polymers are described immediately above in formal structural terms, but are usually in fact made by grafting the substituted aminomethyl groups onto some or all of the aromatic rings of a simple 4-hydroxystyrene polymer, as taught in U.S. Pat. No. 5,068,299 of Nov. 26, 1991 to Lindert et al., the entire disclosure of which, except to any extent that it may be inconsistent with any explicit statement herein, is hereby incorporated herein by reference); (2) epoxy resins, particularly polymers of the diglycidyl ether of bisphenol-A, optionally capped on the ends with non-polymerizable groups and/or having some of the epoxy groups hydrolyzed to hydroxyl groups, and (3) polymers of acrylic and methacrylic acids and their salts.

Another optional component in a composition according to this invention may be selected from the group consisting of water soluble oxides, carbonates, and hydroxides of the elements Ti, Zr, Hf, B, Al, Si, Ge, and Sn. This component, the other optional component described in the immediately preceding paragraph, and the necessary component of alizarine dye generally are preferably not present in the precursor mixture of water and necessary initial reagent components (A.1) and (A.2) before the chemical interaction that converts this mixture into a stably homogeneous mixture as described above is complete.

The resulting compositions are suitable for treating metal surfaces to achieve excellent resistance to corrosion, particularly after subsequent conventional coating with an organic binder containing protective coating. The compositions are particularly useful on aluminum but may also be used on iron and steel, galvanized iron and steel, and zinc and those of its alloys that contain at least 50 atomic percent zinc. The treating process may consist either of coating the metal with a liquid film of the composition and then drying this liquid film in place on the surface of the metal, or simply contacting the metal with the composition for a sufficient time to produce an improvement in the resistance of the surface to corrosion, and subsequently rinsing before drying. Such contact may be achieved by spraying, immersion, and the like as known per se in the art. When this latter method is used, it is optional, and often advantageous, to contact the metal surface with an aqueous composition comprising polymers and copolymers of one or more x-(N-$R^1$-N-$R^2$-aminomethyl)4-hydroxy-styrenes, where x, $R^1$, and $R^2$ have the same meanings as already described above, after (i) contacting the metal with a composition containing a product of reaction between initial reagent components (A.1) and (A.2) as described above, (ii) removing the metal from contact with this composition containing components (A.1) and (A.2) as described above, and (iii) rinsing with water, but before drying.

Necessary initial reagent component (A.1) preferably is selected from the group consisting of $H_2TiF_6$, $H_2ZrF_6$, $H_2HfF_6$, $H_2SiF_6$, and $HBF_4$; $H_2TiF_6$, $H_2ZrF_6$, $H_2SiF_6$ are more preferred; and $H_2TiF_6$ is most preferred. The concentration of fluoroacid component at the time of its interaction with initial reagent component (A.2) preferably is at least, with increasing preference in the order given, 0.01, 0.05, 0.10, 0.15, 0.20, 0.25, and 0.30 moles of the fluoroacid per liter of the reaction mixture, a concentration unit that may be used hereinafter for other constituents in any liquid mixture and is hereinafter usually abbreviated as "M" and independently preferably is not more than, with increasing preference in the order given, 7.0, 6.0, 5.0, 4.0, 3.5, 3.0, 2.5, 2.0, 1.8, 1.6, 1.4, or 1.2 M.

Initial reagent component (A.2) of metallic and/or metalloid elements and/or their oxides, hydroxides, and/or carbonates is preferably selected from the group consisting of the oxides, hydroxides, and/or carbonates of silicon, zirconium, and/or aluminum and more preferably includes silica. Any form of this component that is sufficiently finely divided to be readily dispersed in water may be reacted with component (A.1) to form the necessary component other than dye in a composition according to this invention as described above. For any constituent of this component that may have low solubility in water, it is preferred that the constituent be amorphous rather than crystalline, because crystalline constituents can require a much longer period of heating and/or a higher temperature of heating to produce a composition that is no longer susceptible to settling and optically transparent. Solutions and/or sols such as silicic acid sots may be used, but it is highly preferable that they be substantially free from alkali metal ions as described further below. However, it is generally most preferred to use dispersions of silica made by pyrogenic processes.

An equivalent of a constituent of necessary initial reagent component (A.2) is defined for the purposes of this description as the amount of the material containing a total of Avogadro's Number (i.e., $6.02\times10^{23}$) of atoms of elements selected from the group consisting of Ti, Zr, Hf, B, Al, Si, Ge, and Sn. The ratio of moles of fluoroacid initial reagent component (A.1) to total equivalents of initial reagent component (A.2) in an aqueous composition in which these two initial reagent components chemically interact to produce a necessary component of a composition according to this invention preferably is at least, with increasing preference in the order given, 1.0:1.0, 1.3:1.0, 1.6:1.0, or 1.9:1.0 and independently preferably is not more than, with increasing preference in the order given, 50:1.0, 35:1.0, 20:1.0, 15:1.0, 10:1.0, or 5.0:1.0. If desired, a constituent of this component may be treated on its surface with a silane coupling agent or the like that makes the surface oleophilic.

According to a preferred method of preparing the product of chemical interaction between initial reagent components (A.1) and (A.2) that is necessary to this invention, an aqueous liquid composition comprising, preferably consisting essentially of, or more preferably consisting of, water and initial reagent components (A.1) and (A.2) as described above, which composition scatters visible light, is not optically transparent in a thickness of 1 cm, and/or undergoes visually detectable settling of a solid phase if maintained for at least 100 hours at a temperature between its freezing point and 20° C., is maintained at a temperature of at least 21° C., optionally with mechanical agitation, for a sufficient time to produce a composition that (i) does not suffer any visually detectable settling when stored for a period of 100, or more preferably 1000, hours and (ii) is optically transparent in a thickness of 1 cm. Preferably, the temperature at which the initial mixture of components (A.1) and (A.2) is maintained is in the range from 25 to 100° C., or more preferably within the range from 30 to 80° C., and the time that the composition is maintained within the stated temperature range is within the range from 3 to 480, more preferably from 5 to 90, or still more preferably from 10 to 30, minutes (hereinafter often abbreviated as "min"). Shorter times and lower temperatures within these ranges are generally adequate for completion of the needed chemical interaction when initial reagent component (A.2) is selected only from dissolved species and/or dispersed amorphous species without any surface treatment to reduce their hydrophilicity, while longer times and/or higher temperatures within these ranges are likely to be needed if initial reagent component (A.2) includes dispersed solid crystalline materials and/or solids with surfaces treated to reduce their hydrophilicity. With suitable equipment for pressurizing the reaction mixture, even higher temperatures than 100° C. can be used in especially difficult instances.

Independently, it is preferred that the pH of the aqueous liquid composition combining reagent components (A.1) and (A.2) as described above be kept in the range from 0 to 4, more preferably in the range from 0.0 to 2.0, or still more preferably in the range from 0.0 to 1.0 before beginning maintenance at a temperature of at least 21° C. as described above. This pH value is most preferably achieved by using appropriate amounts of components (A.1) and (A.2) themselves rather than by introducing other acidic or alkaline materials.

After completion of the necessary chemical interaction between initial reagent components (A.1) and (A.2) as described above, necessary dye component (B) and if desired one or both of the optional components described above may be mixed in any order with the product of the chemical interaction between components (A.1) and (A.2) and the water in which the interaction occurred. If the mixture of water and the interaction product of (A.1) and (A.2) has been heated to a temperature above 30° C., it is preferably brought below that temperature before any of the other components are added. In a final composition according to the invention, dye component (B) preferably is present in an amount with a mass that has a ratio, to the mass of initial reagent component (A.1) used to prepare the same composition, that is at least, with increasing preference in the order given, 0.00007:1.00, 00010:1.0, 0.00020:1.00, or 0.00030:1.00, and if the composition is intended for use by the contact-and-rinse method more preferably is at least, with increasing preference in the order given, 0.00040:1.00, 0.00045:1.00, or 0.00050:1.00 and independently preferably, primarily for economy, is not more than, with increasing preference in the order given, 0.0050:1.00, 0.0035:1.00, or 0.0015:1.0, and unless the composition is intended for use by the contact-and-rinse method more preferably is not more than, with increasing preference in the order given, 0.0012:1.00, 0.0010:1.00, 0.00080:1.00, or 0.00060:1.00. If the concentration of dye is too low, the visual effect of its presence in the finished conversion coating will not be sufficiently apparent to be useful, while if the concentration of dye is too high, the visual appearance will not easily discriminate as desired between thick and thin conversion coatings.

Preferably, the optional component of water-soluble polymers is included in a composition according to the invention as described above, more preferably in an amount such that the ratio by weight of this optional component to the total of initial reagent component (A.1) as described above is at least, with increasing preference in the order given, 0.05:1.0, 0.10:1.0, 0.15:1.0, 0.20:1.0, 0.25:1.0, 0.30:1.0, 0.35:1.0, or 0.38:1.0 and independently preferably is not more than, with increasing preference in the order given, 3.0:1.0, 2.5:1.0, 2.0:1.0, 1.6:1.0, 1.2:1.0, 0.90:1.0, 0.70:1.0, 0.60:1.0, 0.55:1.0, 0.50:1.0, or 0.45:1.0.

A composition prepared by a process as described above constitutes another embodiment of this invention. It is normally preferred that compositions according to the invention as defined above should be substantially free from many ingredients used in compositions for similar purposes in the prior art. Specifically, it is often increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, or 0.001% of each of the following constituents: hexavalent chromium; ferricyanide; ferrocyanide; anions containing molybdenum or tungsten; nitrates and other oxidizing agents (the others being measured as their oxidizing stoichiometric equivalent as nitrate); phosphorus and sulfur containing anions that are not oxidizing agents; alkali metal and ammonium cations; and organic compounds with two or more hydroxyl groups per molecule and a molecular weight of less than 300. The preference for minimal amounts of alkali metal and ammonium cations applies only to compositions used for processes according to the invention that include drying into place on the metal surface to be treated without rinsing after contact between the metal surface and the composition; when a composition according to the invention is contacted with a metal surface and the metal surface is subsequently rinsed with water before being dried, any alkali metal and ammonium ions present are usually removed by the rinsing to a sufficient degree to avoid any substantial diminution of the protective value of subsequently applied organic binder containing protective coatings.

Still another embodiment of the invention is a process of treating a metal with a composition according to the invention as described above. In one embodiment of the invention, it is preferred that the acidic aqueous composition as noted above be applied to the metal surface and dried in place thereon. For example, coating the metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between coating rolls, and the like.

If the surface to be coated is a continuous flat sheet or coil and precisely controllable coating techniques such as gravure roll coaters are used, a relatively small volume per unit area of a concentrated composition may effectively be used for direct application. On the other hand, if the coating equipment used does not readily permit precise coating at low coating add-on liquid volume levels, it is equally effective to use a more dilute acidic aqueous composition to apply a thicker liquid coating that contains about the same amount of active ingredients. In either case, it is preferred that the total mass of conversion coating dried into place on the surface that is treated should be at least, with increasing preference in the order given, 10, 20, 40, 75, 100, 150, 200, 250, 300, 325, 340, or 355 milligrams per square meter of substrate surface area treated (hereinafter often abbreviated as "$mg/m^2$") and independently, primarily for reasons of economy, preferably is not more than, with increasing preference in the order given, 1000, 750, 600, 500, 450, or 400 $mg/m^2$.

Drying may be accomplished by any convenient method, of which many are known per se in the art; examples are hot air and infrared radiative drying. Independently, it is preferred that the maximum temperature of the metal reached during drying fall within the range from 30 to 200, more preferably from 30 to 150, still more preferably from 30 to 75,° C. Also independently, it is often preferred that the drying be completed within a time ranging from 0.5 to 300, more preferably from 2 to 50, still more preferably from 2 to 10, seconds (hereinafter abbreviated "sec") after coating is completed.

According to an alternative embodiment of the invention, the metal to be treated preferably is contacted with a composition prepared as described above at a temperature that is at least, with increasing preference in the order given, 15, 17, 19, or 21° C. and independently preferably, primarily for economy, is not more than, with increasing preference in the order given, 90, 85, 80, 75, 70, 65, 60, 55, 50, or 45° C. Independently, the time of contact is at least, with increasing preference in the order given, 1, 3, or 5 sec and independently preferably is not more than, with increasing preference in the order given, 18, 14, 12, 10, 8, or 6 min, and the metal surface thus treated is subsequently rinsed with water in one or more stages before being dried. In this embodiment, at least one rinse after treatment with a composition according this invention preferably is with deionized, distilled, or otherwise purified water. Also in this embodiment, it is preferred that the maximum temperature of the metal reached during drying fall within the range from 30 to 200, more preferably from 30 to 150, or still more preferably from 30 to 75,° C. and that, independently, drying be completed within a time ranging from to 0.5 to 300, more preferably from 2 to 50, still more preferably from 2 to 10, sec after the last contact of the treated metal with a liquid before drying is completed.

A process according to the invention as generally described in its essential features above may be, and usually preferably is, continued by coating the dried metal surface produced by the treatment as described above with a siccative coating or other protective coating, relatively thick as compared with the coating formed by the earlier stages of a process according to the invention as described above. Such protective coatings may generally, in connection with this invention, be selected and applied as known per se in the art. Surfaces thus coated have been found to have excellent resistance to subsequent corrosion, as illustrated in the examples below. Particularly preferred types of protective coatings for use in conjunction with this invention include acrylic and polyester based paints, enamels, lacquers, and the like.

In a process according to the invention that includes other steps after the formation of a treated layer on the surface of a metal as described above and that operates in an environment in which the discharge of hexavalent chromium is either legally restricted or economically handicapped, it is generally preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. Examples of suitable and preferred chromium free treatments are described in U. S. Pat. No. 4,963,596.

Preferably, any metal surface to be treated according to the invention is first cleaned of any contaminants, particularly organic contaminants and metal fines and/or foreign metal inclusions. Such cleaning may be accomplished by methods known to those skilled in the art and adapted to the particular type of metal substrate to be treated. For example, for galvanized steel surfaces, the substrate is most preferably cleaned with a conventional hot alkaline cleaner, then rinsed with hot water, squeegeed, and dried. For aluminum, the surface to be treated most preferably is first contacted with a conventional hot alkaline cleaner, then rinsed in hot water, then, optionally, contacted with a neutralizing acid rinse, before being contacted with an acid aqueous composition according to this invention as described above.

The practice of this invention may be further appreciated by consideration of the following, non-limiting examples.

Group I—Dry-in-Place Processing

Composition Example 1

| | |
|---|---|
| 56.6 | parts of aqueous 60% fluorotitanic acid (i.e., $H_2TiF_6$) |
| 5.6 | part of amorphous fumed silicon dioxide |
| 396.2 | parts of deionized water |
| 0.68 | parts of alizarine (also known as "Cl Mordant Red 11") |
| 325.4 | parts of deionized water |
| 216.2 | parts of an aqueous solution containing 10% solids of water soluble polymer (Mannich adduct of poly{4-vinylphenol} with N-methylglucamine and formaldehyde) made according to the directions of column 11 lines 39–52 of U.S. Pat. No. 4,963,596. |

Composition Example 2

| | |
|---|---|
| 58.8 | parts of aqueous 60% fluorotitanic acid |
| 646.0 | parts of deionized water |
| 5.9 | parts of amorphous fumed silicon dioxide |
| 10.5 | parts of zirconium hydroxide |
| 278.8 | parts of the 10% solution of water soluble polymer as used in Composition Example 1 |
| 1.6 | parts of 1,2,4,5,6,8-hexahydroxyanthroquinone (Cl Mordant Blue 32). |

Composition Example 3

| | |
|---|---|
| 62.9 | parts of aqueous 60% fluorotitanic acid |
| 330.5 | parts of deionized water |
| 6.2 | parts of amorphous fumed silicon dioxide |
| 358.9 | parts of deionized water |
| 241.5 | parts of the 10% solution of water soluble polymer as used in Composition Example 1 |
| 1.9 | parts of Cl Mordant Blue 48. |

Composition Example 4

| | |
|---|---|
| 56.4 | parts of aqueous 60% fluorotitanic acid |
| 56.4 | parts of deionized water |
| 2.1 | parts of Aerosil ™ R-972 (a surface treated dispersed silica from Degussa Corp.) |
| 667.0 | parts of deionized water |
| 218.1 | parts of the 10% solution of water soluble polymer as used in Composition Example 1 |
| 3.3 | parts of Alizarine Brilliant Blue (a commercially obtained product from Keystone Chicago, Code 201-045-65). |

Composition Example 5

| | |
|---|---|
| 58.8 | parts of aqueous 60% fluorotitanic acid |
| 3.7 | parts of amorphous fumed silicon dioxide |
| 10.3 | parts of zirconium basic carbonate |
| 647.7 | parts of deionized water |

-continued

| | |
|---|---|
| 279.5 | parts of the 10% solution of water soluble polymer as used in Composition Example 1 |
| 1.1 | parts of Alizarine Brilliant Blue. |

Composition Example 6

| | |
|---|---|
| 52.0 | parts of aqueous 60% fluorotitanic acid |
| 297.2 | parts of deionized water |
| 3.3 | parts of amorphous fumed silicon dioxide |
| 9.1 | parts of zirconium basic carbonate |
| 273.6 | parts of deionized water |
| 364.8 | parts of the 10% solution of water soluble polymer as used in Composition Example 1 |
| 1.1 | parts of Alizarine Brilliant Blue. |

Composition Example 7

| | |
|---|---|
| 666.0 | parts of deionized water |
| 83.9 | parts of 60% aqueous fluorotitanic acid |
| 5.3 | parts of Cab-O-Sil ™ M-5 fumed amorphous silicon dioxide (from Cabot Corp.) |
| 14.8 | parts of zirconium basic carbonate |
| 230.0 | parts of RDX 68654 ™ (also known as RIX 95928 ™) epoxy resin dispersion commercially available from Rhône-Poulenc, containing 40% solids of polymers of predominantly diglycidyl ethers of bisphenol-A, in which some of the epoxide groups have been converted to hydroxy groups and the polymer molecules are phosphate capped |
| 1.3 | parts of Alizarine Brilliant Blue. |

Composition Example 8

| | |
|---|---|
| 656.0 | parts of deionized water |
| 183.9 | parts of 60% aqueous fluorotitanic acid |
| 5.3 | parts of Cab-O-Sil ™ M-5 fumed amorphous silicon dioxide |
| 14.8 | parts of zirconium basic carbonate |
| 240.0 | parts of Accumer ™ 1510, a commercially available product from Rohm & Haas containing 25% solids of polymers of acrylic acid with a molecular weight of about 60,000 |
| 3.3 | parts of Alizarine Brilliant Blue. |

Composition Example 9

| | |
|---|---|
| 636.2 | parts of deionized water |
| 83.7 | parts of 60% aqueous fluorotitanic acid |
| 5.3 | parts of Cab-O-Sil ™ M-5 fumed amorphous silicon dioxide |
| 14.6 | parts of zirconium basic carbonate |
| 37.6 | parts of the 10% solution of water soluble polymer as used in Composition Example 1 |
| 222.6 | parts of Accumer ™ 1510 |
| 1.1 | parts of Alizarine Brilliant Blue. |

For each of Composition Examples 1–9, the ingredients are added in the order indicated to a container provided with stirring. (Glass containers are susceptible to chemical attack by the compositions and generally should not be used, even on a laboratory scale; containers of austenitic stainless steels such as Type 316 and containers made of or fully lined with resistant plastics such as polymers of tetrafluoroethene or chlorotrifluoroethene have proved to be satisfactory.) In each of these examples except Composition Example 4, after the addition of the silica component and before the addition of the subsequently listed components, the mixture is heated to a temperature in the range from 38–43° C. and maintained within that range of temperatures for a time of 20–30 minutes. Then the mixture is cooled to a temperature below 30° C., and the remaining ingredients are stirred in without additional heating, until a transparent solution is obtained after each addition.

For Composition Example 4, the $SiO_2$ used is surface modified with a silane, and because of its hydrophobic nature, the mixture containing this form of silica is heated for 1.5 hours at 70° C. to achieve transparency. The remaining steps of the process are the same as for Composition Example 1.

General Conditions Using Composition Examples 1–9

Test pieces of Type 3105 aluminum are spray cleaned for 15 seconds at 54.4° C. with an aqueous cleaner containing 28 g/L of PARCO®Cleaner 305 (commercially available from the Henkel Surface Technologies Division of Henkel Corp., Madison Heights, Mich., USA; this supplier is hereinafter usually abbreviated as "HST"). After cleaning, the panels are rinsed with hot water, squeegeed, and dried before roll coating with an acidic aqueous composition as described for the individual examples above. The applied liquid composition according to the invention is flash dried in an infrared oven that produces approximately 49° C. peak metal temperature. Conversion coating add-on weights (more formally masses per unit area) within a range from 18 to 65 mg/m$^2$, measured as their titanium content only, are achieved with each composition.

Samples thus treated are subsequently over-coated, according to the recommendations of the suppliers, with at least one of the following commercial paints: PPG Duracron™ 1000 White Single Coat Acrylic Paint, Lilly™ Colonial White Single Coat Polyester, Valspar/Desoto™ White Single Coat Polyester, Valspar™ Colonial White Single Coat Polyester, and Lilly™ Black Single Coat Polyester to produce final samples for corrosion testing. T-Bend tests according to American Society for Testing Materials (hereinafter "ASTM") Method D4145-83; Impact tests according to ASTM Method D2794-84E1; Salt Spray tests according to ASTM Method B-117-90 Standard; Acetic Acid Salt Spray tests according to ASTM Method B-287-74 Standard; Humidity tests according to ASTM D2247-8 Standard; and tests of resistance to boiling water immersion on the conversion coated and subsequently over-coated substrates thus prepared indicate high quality corrosion resistance of these over-coated substrates.

Group II—Contact-and-Rinse Processing

Composition Example 10 is a solution in deionized water containing 3.0% of Composition Example 1.

Composition Example 11 is a solution in deionized water containing 1.0% of Composition Example 1.

Concentrate I used in each of Composition Examples 12 and 13 has the following constituents:

| | |
|---|---|
| 1892.7 | parts of deionized water |
| 83.7 | parts of 60% aqueous fluorotitanic acid |
| 5.3 | parts of Cab-O-Sil ™ M-5 fumed amorphous silicon dioxide |

-continued

| | |
|---|---|
| 18.3 | parts of zirconium basic carbonate |
| 1.5 | parts of Alizarine Brilliant Blue. |

These ingredients are simply mixed together with mechanical agitation in the order shown, with a pause after each addition until the solution becomes transparent. Although the partial mixture is not transparent immediately after addition of the silicon dioxide, it becomes clear after a few minutes of mixing, even without any heating.

Composition Example 12 is prepared by diluting 200 grams of Concentrate I, along with sufficient sodium carbonate to result in a final pH of 2.92±0.2, to form 6 liters of Composition Example 12.

Composition Example 13 is prepared in the same way as Composition Example 12, except that it also contains 5 grams of a concentrated polymer solution made according to the directions of column 11 lines 39–49 of U.S. Pat. No. 4,963,596, except as follows: The preparation was carried out on a substantially larger scale; the proportions of ingredients were changed to the following: 241 parts of Propasol™ P, 109 parts of Resin M, 179 parts of N-methylglucamine, 73.5 parts of aqueous 37% formaldehyde, and 398 parts of deionized water, of which 126 parts were reserved for a final addition not described in the noted patent, with the remainder used to slurry the N-methylglucamine as noted in the patent; and the temperature noted as 60–65° C. in the patent was reduced to 57° C.

General Conditions Using Composition Examples 10–13

Test pieces of Type 5352 or 5182 aluminum are spray cleaned for 10 seconds at 54.4° C. with an aqueous cleaner containing 24 g/L of PARCO® Cleaner 305. After cleaning, the panels are rinsed with hot water; then they are sprayed with one of Composition Examples 10 or 11 for 5 seconds; and then they are rinsed successively with cold tap water and deionized water and dried, prior to over-coating as described for Group I above. Coating weights from 2.3 to 11.4 m/m$^2$, measured as titanium only, are obtained, and corrosion testing indicates high quality resistance to corrosion.

Concentrate 11 used in Composition Example 14 had the following constituents:

| | |
|---|---|
| 896 | parts of deionized water |
| 27.9 | parts of 60% aqueous fluorotitanic acid |
| 1.4 | parts of Cab-O-Sil ™ M-5 fumed amorphous silicon dioxide |
| 4.9 | parts of zirconium basic carbonate |
| 68 | parts of the 10% solution of water soluble polymer as used in Composition Example 1 |
| 0.5 | parts of Alizarine Brilliant Blue. |

These constituents were used to make the concentrate in the same manner as is described above for Composition Examples 1–9.

Composition Example 14 was a 3% solution in deionized water of Concentrate II. This composition was used in the following process sequence:

1. Spray for 60 seconds at 60° C. with a 2% solution of SPRAY WAND™ 330 cleaner concentrate (commercially available from HST) in water.
2. Spray rinse for 30 seconds with cold tap water.
3. Spray with Composition Example 14 at ambient temperature (i.e., 18–23° C.) for 15 seconds.
4. Spray rinse with cold tap water for 30 seconds.

This process sequence produced a coating mass per unit area of 323 mg/m$^2$. The samples thus coated, and comparison samples treated in the same manner, except that the Alizarine Brilliant Blue Dye was eliminated from the treatment composition, were both painted with a PPG bronze paint and subjected to corrosion testing. The results with Composition 14 and with its comparison composition were very similar.

Composition and Process Example 15 The composition according to the invention consisted of a solution in water of 0.5 grams per liter of xanthylium, 9-(2-carboxyphenyl)-3,6-bis(diethylamino)-, chloride dye and 3% of a concentrate that was made substantially in accordance with the directions for Example 6 of U.S. Pat. No. 5,281,282 except that the amounts of the ingredients used were changed to 28 parts of aqueous 60% fluorotitanic acid, 1.4 parts of amorphous fumed silica, 4.9 parts of zirconium basic carbonate, 88 parts of water soluble polymer solution, and 898 parts of deionized water. Test pieces of Type 6061 aluminum were cleaned by immersion for 10 seconds at 49 to 60° C. in an aqueous alkaline cleaner containing 10% of RIDOLINE® 4355 Cleaner Concentrate from HST. After cleaning, the panels were rinsed twice with water, deoxidized, and then again rinsed twice with water; they were then immersed for 1–6 minutes in the last above noted composition according to the invention, rinsed successively with cold tap water and deionized water and dried, prior to over-coating some of the samples with a thickness of 20 micrometres of white solvent-borne coil coating paint. The uncoated samples were tested for water solubility of the colored coating formed and painted samples were tested for bleed of color through the paint, and neither water solubility nor bleed of color were observed.

Concentration and Process Example 16 This composition and process were the same as Example 14, except that the dye used was Benzenemethanaminium, N-ethyl-N-[4-[[4-[ethyl[(3-sulfophenyl)methyl]amino]phenyl](2-sulfophenyl)methylene]-2,5-cyclohexadien-1-ylidene]-3-sulfo-, inner salt, diammonium salt instead of Xanthylium, 9-(2-carboxyphenyl)-3,6-bis(diethylamino)-, chloride, and none of the samples was painted or tested for bleed of the dye color through paint.

What is claimed is:

1. An aqueous liquid composition of matter for producing a readily visible conversion coating on a metal surface by spontaneous chemical reaction therewith, without requiring any imposition of external electromotive force, said composition comprising water and:

(A) a product of chemical interaction between:

(A.1) an amount, all of which is dissolved in the water, of a first initial reagent component selected from the group consisting of fluoroacids of the elements titanium, zirconium, hafnium, boron, aluminum, silicon, germanium, and tin; and (A.2) an amount, which may be dissolved, dispersed, or both dissolved and dispersed in the water, of a second initial reagent component selected from the group consisting of titanium, zirconium, hafnium, boron, aluminum, silicon, germanium, and tin and all of oxides, hydroxides, and carbonates of all of titanium, zirconium, hafnium, boron, aluminum, silicon, germanium, and tin;

and (B) an amount, sufficient to impart a color to the composition, of a component selected from the group consisting of alizarine dyes.

2. A composition according to claim 1, wherein:

an amount corresponding to a total concentration of at least about 0.05 M of fluoroacids selected from the group consisting of $H_2SiF_6$, $H_2TiF_6$, and $H_2ZrF_6$ is reacted to make component (A);

an amount of second initial reagent that is selected from the group consisting of the oxides, hydroxides, and carbonates of all of silicon, zirconium, and aluminum and that corresponds to a number of moles of said second initial reagent such that the ratio of the number of moles of fluoroacids to the number of moles of said second initial reagent that are reacted to make component (A) is within a range from about 1.0:1.0 to about 50:1.0; and the amount of alizarine dye component corresponds to a mass that has a ratio to the mass of said amount of fluoroacids that is from about 0.0007:1.00 to about 0.020:1.00.

3. A composition according to claim 2, wherein:

an amount corresponding to a total concentration of at least about 0.15 M of fluoroacids selected from the group consisting of $H_2SiF_6$, $H_2TiF_6$, and $H_2ZrF_6$ is reacted to make component (A);

an amount of second initial reagent that is selected from the group consisting of the oxides, hydroxides, and carbonates of all of silicon, zirconium, and aluminum and that corresponds to a number of moles of said second initial reagent such that the ratio of the number of moles of fluoroacids to the number of moles of said second initial reagent that are reacted to make component (A) is within a range from about 1.3:1.00 to about 20:1.00; and the amount of alizarine dye component corresponds to a mass that has a ratio to the mass of said amount of fluoroacids that is from about 0.00040:1.00 to about 0.020:1.00.

4. A composition according to claim 3, additionally comprising water soluble polymers of one or more x-(N—$R^1$—N—$R^2$-aminomethyl)-4-hydroxy-styrenes, where x (the substitution position number)=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 3 to 5.

5. A composition according to claim 4, wherein:

an amount corresponding to a total concentration of not more than about 1.2 M of fluoroacids selected from the group consisting of $H_2SiF_6$, $H_2TiF_6$, and $H_2ZrF_6$ is reacted to make component (A);

an amount of second initial reagent that is selected from the group consisting of the oxides, hydroxides, and carbonates of all of silicon, zirconium, and aluminum and that corresponds to a number of moles of said second initial reagent such that the ratio of the number of moles of fluoroacids to the number of moles of said second initial reagent that are reacted to make component (A) is within a range from about 1.6:1.00 to about 5.0:1.00; and the amount of alizarine dye component corresponds to a mass that has a ratio to the mass of said amount of fluoroacids that is at least about 0.00070:1.00.

6. A composition according to claim 5, wherein:

an amount corresponding to a total concentration of at least about 0.15 M of $H_2TiF_6$, and $H_2ZrF_6$ is reacted to make component (A); and an amount of silica that corresponds to a number of moles of silica such that the ratio of the number of moles of fluoroacids to the number of moles of silica that are reacted to make component (A) is within a range from about 1.6:1.00 to about 5.0:1.00.

7. A composition according to claim 2, additionally comprising water soluble polymer selected from the group consisting of: (1) polymers of one or more x-(N—$R^1$—N—$R^2$-amino-methyl- 4-hydroxy-styrenes, where x (the substitution position number)=2, 3, 5, or 6, $R^1$ represents an alkyl group containing from 1 to 4 carbon atoms, and $R^2$ represents a substituent group conforming to the general formula $H(CHOH)_nCH_2$—, where n is an integer from 1 to 7; (2) epoxy resins that are polymers of the diglycidyl ether of bisphenol-A, optionally capped on the ends with non-polymerizable groups, having some of the epoxy groups hydrolyzed to hydroxyl groups, or both; and (3) polymers of acrylic and methacrylic acids and their salts.

8. A composition according to claim 1, additionally comprising water soluble polymer selected from the group consisting of: (1) polymers of one or more x-(N—$R^1$—N—$R^2$-amino-methyl)-4-hydroxy-styrenes, where x (the substitution position number)=2, 3, 5, or 6, $R^1$ represents an alkyl group containing from 1 to 4 carbon atoms and $R^2$ represents a substituent group conforming to the general formula $H(CHOH)_nCH_2$—, where n is an integer from 1 to 7; (2) epoxy resins; and (3) polymers of acrylic and methacrylic acids and their salts.

9. A process of forming a colored conversion coating on a metal surface, said process comprising contacting said metal surface with a composition according to claim 1.

10. A process according to claim 9, wherein is formed a total mass of conversion coating corresponding to from 100 to 500 milligrams of coating per square meter of metal surface coated.

11. A process according to claim 9, wherein said metal surface is comprised of aluminum.

12. A process according to claim 9, wherein a liquid film of the composition thereafter dried in place.

13. A process according to claim 9, wherein said metal surface is rinsed after said contacting.

14. A process according to claim 9, wherein said metal surface is rinsed and dried after said contacting.

15. A process according to claim 9, wherein said contacting is carried out within a temperature range of from 15° C. to 90° C.

16. A process according to claim 9, wherein said contacting is carried out for a time of from 1 second to 18 minutes.

17. A process of forming a colored conversion coating on a metal surface, said process comprising contacting said metal surface with a composition according to claim 2.

18. A process of forming a colored conversion coating on a metal surface, said process comprising contacting said metal surface with a composition according to claim 3.

19. A process of forming a colored conversion coating on a metal surface, said process comprising contacting said metal surface with a composition according to claim 4.

20. A process of forming a colored conversion coating on a metal surface, said process comprising contacting said metal surface with a composition according to claim 5.

21. A process of forming a colored conversion coating on a metal surface, said process comprising contacting said metal surface with a composition according to claim 6.

22. A process of forming a colored conversion coating on a metal surface, said process comprising contacting said metal surface with a composition according to claim 7.

23. A process of forming a colored conversion coating on a metal surface, said process comprising contacting said metal surface with a composition according to claim 8.

24. A composition according to claim 1, additionally comprising one or more additional components selected from the group consisting of water soluble oxides, carbonates and hydroxides of the elements Ti, Zr, Hf, B, Al, Si, Ge and Sn.

25. A process of forming a colored conversion coating on a metal surface, said process comprising contacting said metal surface with a composition according to claim 24.

26. A method of preparing a composition according to claim 1, said method comprising reacting the first initial reagent component and the second initial reagent component in the presence of water to form a homogeneous composition comprised of the product of chemical interaction and combining said homogeneous composition with component B.

27. A method according to claim 26, wherein said homogeneous composition has a pH of from 0 to 4.

* * * * *

UNITED STATES PATENT AND TRADEMARK OFFICE

CERTIFICATE OF CORRECTION

PATENT NO. : 6,464,800 B1
DATED : October 15, 2002
INVENTOR(S) : Carlson et al.

It is certified that error appears in the above-identified patent and that said Letters Patent is hereby corrected as shown below:

Column 14,
Line 14, delete "0.0007:1.00", and insert therefor -- 0.00007:1.00 --.

Column 15,
Line 6, delete "$R^2$-amino-methyl-4-hydroxy-styrenes", and insert therefor -- $R^2$-amino-methyl)-4-hydroxy-styrenes --.

Signed and Sealed this

Third Day of February, 2004

JON W. DUDAS
*Acting Director of the United States Patent and Trademark Office*